US007354492B2

(12) United States Patent
Rashnikov et al.

(10) Patent No.: US 7,354,492 B2
(45) Date of Patent: Apr. 8, 2008

(54) METHOD FOR OPTIMISING THE PRODUCTION TECHNOLOGY OF ROLLED PRODUCTS

(75) Inventors: Viktor Filippovich Rashnikov, Magnitogorsk (RU); Anrdrei Andreevich Morozov, Magnitogorsk (RU); Rafkat Spartakovich Takhautdinov, Magnitogorsk (RU); Gennady Sergeevich Senichev, Magnitogorsk (RU); Vladimir Nikolaevich Urtsev, Magnitogorsk (RU); Felix Vilenovich Kapstan, Magnitogorsk (RU); Anatoly Vilenovich Kapstan, Magnitogorsk (RU); Sergei Anatolievich Murikov, Magnitogorsk (RU); Dim Maratovich Khabibulin, Magnitogorsk (RU); Sergei Iosifovich Platov, Magnitogorsk (RU); Sergei Nikolaevich Anikeev, Magnitogorsk (RU)

(73) Assignees: Otkrytoe Aktsionernoe Obschestvo "Magnitogorsky Metallurgichesky Kombinat", Magnitogorsk (RU); Obschestvo S Ogranichennoi Otvetstvennostyu "Issledovatelsko-Tekhnologichesky Tsentr Ausferr", Magnitogorsk (RU)

( * ) Notice: Subject to any disclaimer, the term of this patent is extended or adjusted under 35 U.S.C. 154(b) by 453 days.

(21) Appl. No.: 10/515,775

(22) PCT Filed: May 22, 2003

(86) PCT No.: PCT/RU03/00224

§ 371 (c)(1),
(2), (4) Date: Nov. 23, 2004

(87) PCT Pub. No.: WO03/104099

PCT Pub. Date: Dec. 18, 2003

(65) Prior Publication Data

US 2005/0178481 A1 Aug. 18, 2005

(30) Foreign Application Priority Data

Jun. 6, 2002 (RU) ..... 2002114912

(51) Int. Cl.
*C21D 7/00* (2006.01)

(52) U.S. Cl. ..... 148/509; 148/508; 148/541

(58) Field of Classification Search ..... 148/508, 148/509, 541

See application file for complete search history.

(56) References Cited

U.S. PATENT DOCUMENTS

| | | | | |
|---|---|---|---|---|
| 3,733,866 | A | 5/1973 | Arimura et al. | |
| 3,762,194 | A | 10/1973 | Maxwell | |
| 5,461,894 | A | 10/1995 | Sorgel | |
| 6,619,137 | B2 | 9/2003 | Yammamoto | |
| 2002/0104597 | A1* | 8/2002 | Frank et al. | 148/541 |
| 2003/0150587 | A1* | 8/2003 | Li et al. | 164/452 |

FOREIGN PATENT DOCUMENTS

| | | | |
|---|---|---|---|
| JP | 2002103306 | | 4/2002 |
| RU | 2078626 | C1 | 5/1997 |
| RU | 2125495 | C1 | 1/1999 |
| RU | 2177847 | C1 | 1/2002 |
| RU | 2207204 | C1 | 6/2003 |
| SU | 1678480 | A2 | 9/1991 |

* cited by examiner

*Primary Examiner*—Scott Kastler
(74) *Attorney, Agent, or Firm*—Christopher L. Parmelee; Walker & Jocke LPA

(57) ABSTRACT

The inventive method is used for optimising a hot and/or cold strip mill process. Said method consists in discreetly measuring the technological parameters of a strip milling and the angular rates of the working rollers of mill stands and table rollers, in defining the liner speed of the strip and selecting a specified number of strip sections having an equal length and used for a subsequent averaging of at least three values of technological parameters for each section, in determining the normative part of the length of the strip, which is divided into sections, for a specific range of rolled products, defining useful quality for each section with respect to the averaged values of the technological parameters of the section rolling, comparing the useful quality with prescribed limits, determining the part of the strip length for which the useful quality values lie within prescribed limits and in using said technological parameters as a standard for milling a strip of the same range or for the range close thereto if the thus obtained part of the strip length is equal to or higher than the normative part, or for rectifying the technological parameters if the thus obtained part is lower than the normative part.

18 Claims, No Drawings

METHOD FOR OPTIMISING THE PRODUCTION TECHNOLOGY OF ROLLED PRODUCTS

FIELD OF THE INVENTION

The invention relates to the art of mechanical treatment of metal by pressure, i.e. to production of rolled products, in particular it relates to controlling of rolling mills and handling of the produced articles in the course of their treatment, and more particularly it relates to the rolling mill's monitoring and adjusting devices that are operable to respond to different variables of the rolled sheets. To a certain extent, the invention relates to auxiliary operations for treatment of metal in the course of rolling thereof.

The invention is particularly intended for optimizing the process of hot and/or cold rolling of strips.

BACKGROUND OF THE INVENTION

Known is the method for adjusting the rolling process, comprising the steps of measuring thickness of a rolled strip, and carrying out the correcting actions as to actuators of the roll drives when a rolled strip thickness deviates from predetermined values (patent RU No. 2125495, assigned to SMS Schloemann-Siemag AG, IPC B 21 B 37/00, 1999). This method provides for measurement of only one parameter, and does not provide for taking into account a change in speed of a rolled strip.

Known is the method for adjusting the rolling process, comprising the steps of measuring the strip rolling process parameters by measuring instruments at a number of points along a mill, and outputting appropriate correcting actions as to actuators (patent RU No. 2078626, assigned to Siemens AG, IPC B 21 B 37/00, 1997). Said method does not include the step of tracking the relationship between the monitored process parameters and particular length values of a rolled strip. For that reason, any exact moment for applying the correcting actions cannot be determined while selecting said correcting actions.

Also known is the method of adjustment of the rolling process, comprising the steps of discretely measuring the monitored strip rolling process parameters at a number of points along a mill, measuring angular velocities of the stand working rolls and table rolls, basing on which measurements a strip linear speed is determined; defining, according to the obtained data, a certain number of equally sized strip sections for subsequent averaging of at least three values of the measured monitored variables at each given section, and determining the required correcting actions as to actuators on the basis of the averaged values of the monitored parameters for a given section (patent RU No. 2177847, cl. B 21 B 37/00, 2002). In the applicant's opinion, this method is the art that is the most pertinent to the claimed invention.

SUMMARY OF THE INVENTION

The invention is based on the concept of continuous, more exactly: quasi-continuous measurement of such process parameters as, for instance, consumer properties of a rolled strip along its length in the course of rolling. These properties can be as follows: ultimate strength ($\sigma_{us}$) yield strength ($\sigma_y$), and/or elongation ($\delta$) of a rolled strip, etc.

According to the invention: the monitored parameters are measured when a strips moves under an appropriate sensor, and/or at an appropriate measuring arrangement; further, for excluding a possibility that the measurement results would be affected by any occasional fluctuations of measured quantities, which are inevitable under conditions of high temperatures and large masses of a moving metal, at least three values obtained at adjacent measurement points are averaged, the obtained averaged values of the process parameters of a rolled article are compared with the standard values, and when said quantities do not coincide, the correcting actions are effected at the relevant sections of a mill. Such action may consist in modifying the gap between rolls, or the cooling action.

More particularly, according to the invention, implemented is a method for optimizing the rolling process by way of determination of settings for a mill, provision of sensors and measuring arrangements at a mill (for example, for selecting specimens of a rolled material) to determine parameters of a rolled strip while a strip is moving, to read and automatically process the sensor indications or the sampling results, and for determining the controlling actions to be performed as to the rolling process. Further, the rolling process parameters that should be monitored according to production specification of a given rolled products' batch are preset. The invention also provides for systematic measuring of the preset parameters' quantities in the course of movement of a rolled strip over a rolling mill. In this context, the "systematic" term means as frequent measurements of parameters as the used instruments allow such frequency, or as required by the monitoring conditions. Then, a number or length of sections of a rolled strip are defined; for each one of the sections, values of the rolling parameters' measured quantities should be obtained separately. Under conditions of the Examples described below, number of sections of the 800-meter (at exit) strip was 50 sections, so that, accordingly, one section was 16 m long. After that, the measured quantities relating to a given section of a rolled strip are averaged, the averaged quantities of the measured parameters are compared with the quantities defined in conformity with production specifications of a given batch of rolled articles. When the compared quantities do not coincide to an extent beyond certain tolerances, then the mill settings are corrected for rolling of next strip, in respect of which next strip these steps are repeated. When the comparison result is positive, the existing settings remain for rolling of next strip.

More specifically, the invention further comprises the steps of: discrete measuring of the strip rolling process parameters, measuring of the angular velocities of the stand working rolls and tables rolls, determining the strip linear speeds; defining a certain number of equally sized strip sections for subsequent averaging of at least three values of the measured process parameters at each given section, setting a rated portion of the strip length subdivided into sections; for a given rolled products range, further defining the consumer properties at each one of the rolled strip sections depending on the averaged values of each section's measured process parameters; comparing the defined consumer properties with the preset limits of the consumer properties; defining a strip length portion wherein the consumer properties are within the preset limits, and establishing these process parameters as the primary standard for rolling of strips of the same or proximate product range—when this defined strip length portion is not less than the rated portion, or amending the process parameters on a new strip—when said defined strip length portion is less than the rated one.

DETAILED DESCRIPTION OF THE INVENTION

EXAMPLE 1

The method was carried out at a continuous wide-strip hot mill. Strips 800 m long, made of steel 08nc (semi-killed steel), 4 mm thick, were rolled. Chemical composition of the rolled steel was indicated in the heat log issued by the steel-making unit: Table 1.

TABLE 1

| | Element | | | | | |
|---|---|---|---|---|---|---|
| | C | Si | Mn | S | P | Al |
| Content, % | 0.09 | 0.01 | 0.42 | 0.023 | 0.015 | 0.044 |

The monitored process parameters were the rolling termination temperature ($T_{re}$) and coiling temperature ($T_{co}$). For measuring the strip rolling termination temperature, a pyrometer positioned at exit from the last finishing stand in the start of the run-out table was used; and the coiling temperature was measured by a pyrometer positioned upstream of the coiler. The strip temperature downstream of the final roughing stand (the sixth stand, $T_6$) was measured by a pyrometer positioned in the start of the span between the roughing and finishing groups of the mill stands. Strip thickness was measured by an X-ray thickness gauge at exit from the mill finishing group; strip parameters were measured discretely 10 times/s by pyrometers and thickness gauge. Angular velocities of working rolls of the final finishing stand, final roughing stand, of the run-out table and intermediary tables' rolls were measured by tachometers mounted on the respective drives. Basing on the angular velocity measurements, taking into account diameters of the stands and table rolls, the strip linear speed was measured, which speed had the following values: 2 m/s within the span between the roughing and finishing groups, and 6.5-11.2 m/s downstream of the stands' finishing group. For each one of 50 sections 16 m long, basing on a value of the strip linear speed: a set of the measured values relating to the time, when each one of said strip sections has passed under a relevant sensor, was determined. The number of sections selected in this case was determined, on the one hand, by the response speed of the used measuring systems and actuators and, on the hand, by the required adjustment accuracy. The measured discrete values of instrument indications were averaged for each section. As the averaged values were within the tolerances of the rolled products range, next strips were rolled under the same settings.

EXAMPLE 2

Under the same initial conditions as were used in Example 1, part from the process parameters mentioned in said Example: values of σ (ultimate strength) and δ (elongation) were determined for each one of the strip sections to check them upon their compliance with requirements of the applicable standards (the general standards and those demanded by a customer).

The obtained data are summarized in Table 2.

TABLE 2

| Section No. | $T_6$ ° C. | $T_{rt}$ ° C. | $T_{co}$ ° C. | Thickness, mm | $\sigma_{us}$ MPa | δ, % |
|---|---|---|---|---|---|---|
| 1 | 1097 | 888 | 563 | 3.04 | 386.7 | 30.1 |
| 2 | 1095 | 900 | 561 | 2.84 | 381.6 | 29.8 |
| 3 | 1088 | 900 | 566 | 2.80 | 380.7 | 29.7 |
| 4 | 1081 | 895 | 575 | 2.83 | 381.5 | 29.9 |
| 5 | 1073 | 895 | 577 | 2.85 | 381.1 | 29.9 |
| 6 | 1064 | 889 | 578 | 2.88 | 383.7 | 30.0 |
| 7 | 1061 | 883 | 578 | 2.93 | 386.5 | 30.0 |
| 8 | 1064 | 885 | 583 | 2.96 | 384.7 | 30.1 |
| 9 | 1069 | 888 | 583 | 2.95 | 383.3 | 30.1 |
| 10 | 1075 | 890 | 582 | 2.94 | 382.6 | 30.1 |
| 11 | 1078 | 894 | 579 | 2.91 | 381.2 | 30.0 |
| 12 | 1080 | 896 | 577 | 2.89 | 380.7 | 30.0 |
| 13 | 1081 | 896 | 577 | 2.87 | 380.7 | 29.9 |
| 14 | 1080 | 898 | 578 | 2.86 | 379.6 | 29.9 |
| 15 | 1079 | 896 | 579 | 2.86 | 380.3 | 30.0 |
| 16 | 1078 | 898 | 586 | 2.86 | 378.2 | 30.0 |
| 17 | 1077 | 899 | 584 | 2.86 | 378.1 | 30.0 |
| 18 | 1077 | 898 | 582 | 2.87 | 378.9 | 30.0 |
| 19 | 1077 | 899 | 580 | 2.86 | 378.8 | 30.0 |
| 20 | 1078 | 902 | 580 | 2.85 | 377.4 | 29.9 |
| 21 | 1078 | 903 | 581 | 2.84 | 376.8 | 29.9 |
| 22 | 1077 | 903 | 583 | 2.84 | 376.4 | 30.0 |
| 23 | 1074 | 901 | 582 | 2.85 | 377.5 | 30.0 |
| 24 | 1070 | 899 | 582 | 2.86 | 378.4 | 30.0 |
| 25 | 1068 | 897 | 582 | 2.86 | 379.3 | 30.0 |
| 26 | 1068 | 897 | 581 | 2.87 | 379.5 | 30.0 |
| 27 | 1070 | 899 | 580 | 2.86 | 378.8 | 30.0 |
| 28 | 1074 | 900 | 581 | 2.85 | 378.1 | 30.0 |
| 29 | 1077 | 904 | 583 | 2.84 | 376.0 | 30.0 |
| 30 | 1080 | 906 | 584 | 2.83 | 374.9 | 30.0 |
| 31 | 1082 | 906 | 585 | 2.82 | 374.7 | 29.9 |
| 32 | 1082 | 906 | 587 | 2.82 | 374.3 | 30.0 |
| 33 | 1082 | 902 | 586 | 2.82 | 376.4 | 30.0 |
| 34 | 1079 | 903 | 582 | 2.82 | 376.6 | 29.9 |
| 35 | 1077 | 901 | 586 | 2.82 | 377.0 | 29.9 |

TABLE 2-continued

| Section No. | $T_6$ ° C. | $T_{rt}$ ° C. | $T_{co}$ ° C. | Thickness, mm | $\sigma_{us}$ MPa | δ, % |
|---|---|---|---|---|---|---|
| 36 | 1078 | 901 | 586 | 2.82 | 376.8 | 30.0 |
| 37 | 1078 | 900 | 580 | 2.83 | 378.3 | 29.9 |
| 38 | 979 | 901 | 585 | 2.83 | 377.0 | 30.0 |
| 39 | 1080 | 903 | 590 | 2.83 | 375.2 | 30.0 |
| 40 | 1082 | 904 | 590 | 2.83 | 374.8 | 30.0 |
| 41 | 1083 | 905 | 589 | 2.82 | 374.5 | 30.0 |
| 42 | 1084 | 905 | 590 | 2.82 | 374.3 | 30.0 |
| 43 | 1084 | 901 | 590 | 2.82 | 376.1 | 30.0 |
| 44 | 1082 | 903 | 590 | 2.82 | 375.2 | 30.0 |
| 45 | 1080 | 901 | 589 | 2.83 | 376.3 | 30.0 |
| 46 | 1078 | 900 | 599 | 2.84 | 375.1 | 30.1 |
| 47 | 1076 | 902 | 602 | 2.84 | 373.6 | 30.1 |
| 48 | 1077 | 903 | 601 | 2.83 | 373.3 | 30.1 |
| 49 | 1081 | 904 | 603 | 2.81 | 372.5 | 30.1 |
| 50 | 1081 | 898 | 644 | 2.88 | 368.3 | 30.6 |
| Tolerance, | 1060-1100 (95%) | 880-910 (95%) | 560-590 (90%) | 2.8-3.2 (92%) | 295.4-384.5 (92%) | >28.5 (92%) |
| Within Tolerance, | 100% | 100% | 90% | 100% | 94.0% | 100% |
| Fitness to use | yes | yes | yes | yes | yes | yes |

It follows from Table 2 that the strip length portion wherein the consumer properties' values are within the preset limits, exceeds the strip length rated portion having the consumer properties' values within the preset limits (every rolled product range is rated by the engineering specifications on the basis of previous investigations), i.e. for a given chemical composition of steel, the rolling termination temperature of 886° C. and that of coiling of 680° C. provided the strip mechanical properties required by the applicable standard. These values were subsequently used as the primary standard for strip rolling of the same or proximate range of rolled products (having a proximate metal composition and thickness). For subsequent rolling of strips of the same or proximate product range, the established primary standard was used for setting $T_{rt}$ and $T_{ro}$ process values.

EXAMPLE 3

Under the initial conditions of Example 2, strips selected from a group having a somewhat different chemical composition were rolled. Data on the same measurements for this strip are summarized in Table 3.

TABLE 3

| Section No. | $T_6$ ° C. | $T_{rt}$ ° C. | $T_{co}$ ° C. | Thickness, mm | $\sigma_{us}$ MPa | δ, % |
|---|---|---|---|---|---|---|
| 1 | 1082 | 905 | 583 | 2.99 | 375.5 | 30.2 |
| 2 | 1076 | 908 | 580 | 2.91 | 374.6 | 32.9 |
| 3 | 1070 | 903 | 579 | 2.86 | 377.1 | 32.8 |
| 4 | 1068 | 901 | 572 | 2.83 | 379.2 | 32.7 |
| 5 | 1068 | 900 | 568 | 2.80 | 380.4 | 32.7 |
| 6 | 1069 | 897 | 564 | 2.78 | 382.4 | 32.6 |
| 7 | 1071 | 897 | 552 | 2.77 | 382.8 | 32.6 |
| 8 | 1072 | 899 | 560 | 2.76 | 382.2 | 32.5 |
| 9 | 1074 | 897 | 558 | 2.78 | 383.4 | 32.5 |
| 10 | 1074 | 898 | 560 | 2.79 | 382.6 | 32.6 |
| 11 | 1074 | 899 | 562 | 2.80 | 381.8 | 32.6 |
| 12 | 1074 | 898 | 565 | 2.82 | 381.8 | 32.7 |
| 13 | 1074 | 895 | 567 | 2.83 | 382.8 | 32.7 |
| 14 | 1072 | 893 | 567 | 2.85 | 383.7 | 32.7 |
| 15 | 1072 | 892 | 569 | 2.86 | 383.9 | 32.7 |
| 16 | 1073 | 893 | 568 | 2.87 | 383.6 | 32.8 |
| 17 | 1075 | 894 | 568 | 2.86 | 383.1 | 32.7 |
| 18 | 1075 | 895 | 567 | 2.87 | 382.8 | 32.7 |
| 19 | 1076 | 896 | 567 | 2.86 | 382.4 | 32.7 |
| 20 | 1076 | 895 | 566 | 2.87 | 383.0 | 32.7 |
| 21 | 1075 | 897 | 566 | 2.86 | 382.1 | 32.7 |
| 22 | 1075 | 895 | 565 | 2.86 | 383.2 | 32.7 |
| 23 | 1073 | 893 | 564 | 2.86 | 384.3 | 32.7 |
| 24 | 1068 | 891 | 563 | 2.87 | 385.4 | 32.7 |
| 25 | 1065 | 887 | 563 | 2.88 | 387.2 | 32.7 |
| 26 | 1066 | 884 | 563 | 2.89 | 388.6 | 32.7 |
| 27 | 1068 | 888 | 566 | 2.90 | 386.2 | 32.8 |
| 28 | 1071 | 889 | 565 | 2.90 | 385.9 | 32.8 |
| 29 | 1072 | 893 | 566 | 2.88 | 383.9 | 32.8 |
| 30 | 1073 | 895 | 568 | 2.88 | 382.7 | 32.8 |

TABLE 3-continued

| Section No. | $T_6$ ° C. | $T_{rt}$ ° C. | $T_{co}$ ° C. | Thickness, mm | $\sigma_{us}$ MPa | δ, % |
|---|---|---|---|---|---|---|
| 31 | 1073 | 893 | 566 | 2.87 | 383.9 | 32.7 |
| 32 | 1071 | 892 | 564 | 2.86 | 384.7 | 32.7 |
| 33 | 1068 | 890 | 564 | 2.87 | 385.6 | 32.7 |
| 34 | 1066 | 887 | 566 | 2.87 | 386.7 | 32.7 |
| 35 | 1067 | 886 | 571 | 2.88 | 386.3 | 32.8 |
| 36 | 1068 | 889 | 572 | 2.88 | 384.7 | 32.8 |
| 37 | 1068 | 889 | 576 | 2.89 | 384.0 | 32.9 |
| 38 | 1069 | 890 | 579 | 2.90 | 383.1 | 32.9 |
| 39 | 1068 | 891 | 574 | 2.90 | 383.5 | 32.9 |
| 40 | 1067 | 891 | 571 | 2.89 | 384.0 | 32.8 |
| 41 | 1064 | 889 | 568 | 2.89 | 385.4 | 32.8 |
| 42 | 1060 | 885 | 568 | 2.90 | 387.3 | 32.8 |
| 43 | 1057 | 884 | 566 | 2.90 | 388.1 | 32.8 |
| 44 | 1058 | 883 | 566 | 2.91 | 388.5 | 32.8 |
| 45 | 1065 | 888 | 570 | 2.90 | 385.5 | 32.8 |
| 46 | 1074 | 893 | 571 | 2.89 | 383.1 | 32.8 |
| 47 | 1085 | 901 | 568 | 2.87 | 379.9 | 32.8 |
| 48 | 1094 | 904 | 567 | 2.85 | 378.7 | 32.7 |
| 49 | 1100 | 903 | 620 | 2.83 | 370.1 | 33.2 |
| 50 | 1100 | 903 | 639 | 2.89 | 366.8 | 33.1 |
| Tolerance, | 1060-1100 (95%) | 880-910 (95%) | 560-590 (90%) | 2.8-3.2 (92%) | 294.4-384.5 (92%) | >28.5 (92%) |
| Within Tolerance, | 96.0% | 100% | 94.0% | 100% | 68.0% | 100% |
| Fitness to use | yes | yes | yes | yes | no | yes |

Table 3 shows that values of $\sigma_{us}$ (ultimate strength) exceed the standard values by 32% of the strip length, while the allowed excessive value is 8%. For this reason, for rolling of next strip of that group, the correcting action to be effected at its relevant sections was modified, and said measurement procedure was entirely repeated so that the needed fitness of the strip's rated portion was provided; then the defined mode was being maintained in the course of rolling of other homogeneous blanks.

INDUSTRIAL APPLICABILITY

The invention can be suitably used first of all for rolling of groups of homogeneous blanks, and also can be used for rolling of single blanks, particularly in the cases when subsequent use of separate portions of a rolled sheet for different purposes or different subsequent processes is anticipated.

The invention claimed is:

1. A method for optimizing the production technology of rolled products, said optimizing being effected by determination of operation settings of a rolling mill, comprising the steps of:

at the rolling mill, positioning at least one of a sensor and a measurement arrangement to determine variables of a rolled strip when said strip moves;

reading and computer-aided processing of indications of said sensors and measuring arrangements, and working-out the controlling actions to which the rolling process is to be subjected;

said method being characterized in that it further includes the following steps:

presetting at least one rolling process parameter needed to be monitored for rolled strips according to a production specification for a given batch of rolled products, wherein the production specification includes: at least one preset limit for measured quantities of the at least one preset parameter; and at least one quantity corresponding to a portion of a length of a rolled strip, which quantity is usable to determine if a sufficient length of a strip satisfies the production specification;

systematic measuring of quantities of the at least one preset parameter when a rolled strip moves along the rolling mill;

presetting at least one of a number and a length of a plurality of sections of the rolled strip, for each of which sections the measured quantities of the the at least one preset parameter are obtained separately;

for each section, averaging the measured quantities that relate to the given section of the rolled strip;

comparing the averaged quantities for the sections with the at least one preset limit of the production specification to determine data that indicates a number of sections in which the averaged quantity measured for the respective sections at least one of: is less than, is greater than, and is equal to, the at least one preset limit of the production specification;

comparing the determined data to the quantity of the production specification corresponding to the portion of a length of a rolled strip correcting rolling mill settings for rolling of a next strip responsive to the comparison between the determined data and the quantity of the production specification, indicating that a sufficient length of the strip does not correspond with the production specification.

2. The method as claimed in claim 1, characterized in that the at least one preset parameter includes at least one of: at least one geometric dimension, a rolling termination temperature (Trt), a coiling temperature (Tro), and a strip temperature existing downstream of a final roughing stand (T6).

3. The method as claimed in claims 1 or 2, characterized in that the method further includes the following steps:

discrete measuring of the at least one preset parameter, measuring of angular velocities of stand working rolls and table rolls, determining a linear speed of strip movement, and determining a certain number of the equal-length strip sections for subsequent averaging of at least three values of the measured quantities of the at least one preset parameter at each one of the sections, further establishing a rated portion of the a strip length, subdivided into sections, for a particular range of rolled products, wherein the quantity of the production specification corresponding to the portion of a length of a rolled strip corresponds to the established rated portion;

by at least one of direct, computational, and indirect methods, further determining at least one consumer property at each rolled strip section using the averaged quantity for each section;

comparing the determined consumer properties with at least one further preset limit;

determining a portion of the strip length wherein the determined consumer properties are within the at least one further preset limit; and establishing the current rolling mill settings as a primary standard for the same or proximate products range—when said determined strip length portion is not less than the rated portion, or amending the rolling mill settings for a new strip—when said determined strip length portion is less than the rated portion.

4. A method for optimizing the production technology of rolled products with a rolling mill comprising:

a) providing a production specification for a batch of rolled products, wherein the production specification includes at least one preset limit for at least one characteristic of rolled strips, wherein the production specification includes a rated quantity previously determined for the at least one preset limits, wherein the rated quantity corresponds to a portion of a length of a strip, which rated quantity is usable to determine if a sufficient length of a strip satisfies the production specification;

b) providing at least one rolling mill setting for operating the rolling mill to carry out a rolling process for at least one strip in the batch of rolled products;

c) determining a plurality of sections of the at least one strip which subdivide the at least one strip;

d) while the at least one strip moves through the rolling mill during the rolling process carried out using the at least one rolling mill setting provided in (b), acquiring with at least one sensor a plurality of measurement values for each of the sections of the at least one strip determined in (c);

e) determining for each respective section, at least one property derived from the plurality of measurement values acquired in (d) for each respective section;

f) determining data representative of a quantity of the sections of the at least one strip in which the at least one property determined for each respective section in (e) has a particular comparison relationship with respect to the at least one preset limit of the production specification provided in (a);

g) responsive to the data representative of the quantity of the sections of the at least one strip determined in (f) having a particular comparison relationship with respect to the rated quantity previously determined for the at least one preset limit of the production specification provided in (a), correcting the at least one rolling mill setting for operating the rolling mill to carry out the rolling process for at least one subsequent strip in the batch of rolled products; and h) operating the rolling mill to carry out a rolling process for the at least one subsequent strip using the at least one rolling mill setting corrected in (g).

5. The method according to claim 4, wherein the particular comparison relationship in (g) corresponds to the data representative of the quantity of the sections of the at least one strip determined in (f) corresponding to a length of the at least one strip that is less than the rated quantity.

6. The method according to claim 4, wherein in (a) the rated quantity previously determined for the at least one preset limit corresponds to a quantity of sections of a strip.

7. The method according to claim 6, wherein particular comparison relationship in (g) corresponds to the data representative of the quantity of the sections of the at least one strip determined in (f) being less than the rated quantity.

8. The method according to claim 4, wherein in (a) the at least one preset limit corresponds to at least one range of limits, wherein the particular comparison relationship in (f) corresponds to the at least one property being within the at least one range of limits.

9. The method according to claim 4, wherein in (d) the measurement values acquired by the at least one sensor correspond to geometric dimensions of the at least one strip.

10. The method according to claim 4, wherein in (d) the measurement values acquired by the at least one sensor correspond to thickness measurements of the at least one strip.

11. The method according to claim 4, wherein in (d) the measurement values acquired by the at least one sensor correspond to rolling termination temperatures (Trt) of the at least one strip.

12. The method according to claim 4, wherein in (d) the measurement values acquired by the at least one sensor correspond to coiling temperatures (Tro) of the at least one strip.

13. The method according to claim 4, wherein in (d) the measurement values acquired by the at least one sensor correspond to temperatures (T6) of the at least one strip downstream of a final roughing stand of the rolling mill.

14. The method according to claim 4, wherein in (e) the at least one property for each respective section corresponds to an average of the plurality of measurement values acquired for the respective section.

15. The method according to claim 4, wherein in (e) the at least one property for each respective section corresponds to a level of ultimate strength derived from the plurality of measurement values acquired for the respective section.

16. The method according to claim 4, wherein in (e) the at least one property for each respective section corresponds to a level of elongation derived from the plurality of measurement values acquired for the respective section.

17. The method according to claim 4, further comprising determining the rated quantity for the at least one preset limit by carrying out with at least one previous strip:

i) acquiring with the at least one sensor a plurality of measurement values for each of a plurality of sections of the at least one previous strip while the at least one previous strip moves through the rolling mill during the rolling process carried out using the at least one rolling mill setting;

j) determining for each respective section of the at least one previous strip, at least one property derived from the plurality of measurement values acquired in (i) for each respective section;

k) determining data representative of a quantity of the sections of the at least one previous strip in which the at least one property determined for each respective section in (j) has the particular comparison relationship with respect to the at least one preset limit;

wherein in (a) the rated quantity is established as corresponding to the data representative of a quantity of sections determined in (k) with respect to the at least one previous strip.

18. The method according to claim 4, wherein the rolling mill includes at least two rolls, wherein in (g) correcting the at least one rolling mill setting for operating the rolling mill includes a change to a gap between the at least two rolls.

* * * * *